US008926028B2

(12) United States Patent
Bach et al.

(10) Patent No.: US 8,926,028 B2
(45) Date of Patent: Jan. 6, 2015

(54) DISPLAY CASE FOR AUTOMOBILE TIRE RIMS AND RELATED METHODS

(75) Inventors: Patrick W. Bach, Hamilton, OH (US); William D. Bach, Greer, SC (US)

(73) Assignee: Norwell Sourcing Solutions, LLC, Greer, SC (US)

( * ) Notice: Subject to any disclaimer, the term of this patent is extended or adjusted under 35 U.S.C. 154(b) by 76 days.

(21) Appl. No.: 13/566,449

(22) Filed: Aug. 3, 2012

(65) Prior Publication Data

US 2013/0193817 A1 Aug. 1, 2013

Related U.S. Application Data

(60) Provisional application No. 61/574,458, filed on Aug. 3, 2011.

(51) Int. Cl.

| | |
|---|---|
| ***A47F 3/08*** | (2006.01) |
| ***A47F 3/00*** | (2006.01) |
| ***A47F 7/04*** | (2006.01) |
| *A47F 11/10* | (2006.01) |

(52) U.S. Cl.

CPC . *A47F 3/08* (2013.01); *A47F 3/001* (2013.01); *A47F 3/085* (2013.01); *A47F 7/04* (2013.01); *A47F 11/10* (2013.01)

USPC ..... 312/134; 312/319.7

(58) Field of Classification Search

CPC ..... B60B 30/06; B60B 30/08; B60B 30/00; A47F 7/04; G09F 11/23

USPC ..... 312/319.5–319.8, 134, 135, 114, 117, 312/234, 266, 267, 268, 280, 249.1, 249.8, 312/125; 211/23, 24; 40/493

See application file for complete search history.

(56) References Cited

U.S. PATENT DOCUMENTS

| | | | | |
|---|---|---|---|---|
| 279,366 | A * | 6/1883 | Starzman | 312/135 |
| 698,231 | A * | 4/1902 | Fawkes | 211/24 |
| 2,815,128 | A * | 12/1957 | Kauffman | 211/24 |
| 3,469,708 | A * | 9/1969 | Pennington | 211/1.55 |
| 3,633,295 | A * | 1/1972 | Stropkay | 40/473 |
| 4,044,710 | A * | 8/1977 | Hansen | 116/312 |
| 4,958,587 | A * | 9/1990 | Fogal et al. | 118/206 |
| 5,545,958 | A * | 8/1996 | Kramer | 318/560 |
| 5,626,241 | A * | 5/1997 | Holden | 211/23 |
| 6,062,396 | A * | 5/2000 | Eason | 211/20 |
| 6,656,301 | B2 * | 12/2003 | Kirby | 156/110.1 |
| 2011/0083460 | A1 * | 4/2011 | Thomas et al. | 62/264 |
| 2012/0074084 | A1 * | 3/2012 | Barber et al. | 211/85.8 |

FOREIGN PATENT DOCUMENTS

| | | | |
|---|---|---|---|
| GB | 2013943 | A * | 8/1979 |

* cited by examiner

*Primary Examiner* — Darnell Jayne
*Assistant Examiner* — Andres F Gallego
(74) *Attorney, Agent, or Firm* — J. Bennett Mullinax, LLC

(57) ABSTRACT

Display cases for displaying one or more automobile tire rims and related can include a frame and at least one set of rollers disposed on the frame. The set of rollers can include at least one driver roller that is rotatable by a driver. The rollers of the set of rollers are positionable at a distance relative to each other to support a tire rim on the rollers within the housing so that the tire rim is rotatable upon the rotation of the at least one driver roller.

14 Claims, 7 Drawing Sheets

DISPLAY CASE FOR AUTOMOBILE TIRE RIMS AND RELATED METHODS

RELATED APPLICATION

The presently disclosed subject matter claims the benefit of U.S. Provisional Patent Application Ser. No. 61/574,458, filed Aug. 3, 2011, the disclosure of which is incorporated herein by reference in its entirety.

TECHNICAL FIELD

The present disclosure relates generally to display cases for tire rims used on automobiles and related methods of displaying tire rims wherein the display case permits potential customers to view the rims. More particularly, the subject matter disclosed herein relates to display cases and related methods for automobile tire rims which allow for the rims to be displayed while being rotated.

BACKGROUND

Heretofore, display devices for automobile tire rims have been limited to static displays in show rooms. Such static displays do not allow a viewer to visualize the wheel in motion. Further, since the wheels are stationary in conventional display systems, displays do not attract much visual interest from consumers. Accordingly, there remains room for variation and improvement within the art of wheel merchandise displays.

SUMMARY

In accordance with this disclosure, the present subject matter provides display cases for tire rims used on automobiles and related methods of displaying tire rims for view by potential customers. More particularly, it is an aspect of at least one embodiment of the present subject matter to provide display cases that can display and rotate tire rims in which the rims are supported by rollers such that when at least one of the rollers is engaged by a motor, the tire rim will rotate.

It is a further aspect of at least one embodiment of the present subject matter to provide for a rotational display case for tire rims in which the tire rims may rotate in different directions thereby increasing the visibility to passing consumers.

It is a further aspect of at least one embodiment of the present subject matter to provide for a rotational display case for supporting at least three tire rims and which may be mounted within the display case in a vertical or horizontal configuration.

It is a further aspect of at least one embodiment of the present subject matter to provide for a rotational tire rim display case in which a motor drive shaft is in operative communication with a driving axle used to support and rotate the respective tire rims.

Some of the objects of the subject matter disclosed herein having been stated hereinabove, and which are achieved in whole or in part by the presently disclosed subject matter, other objects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1B:
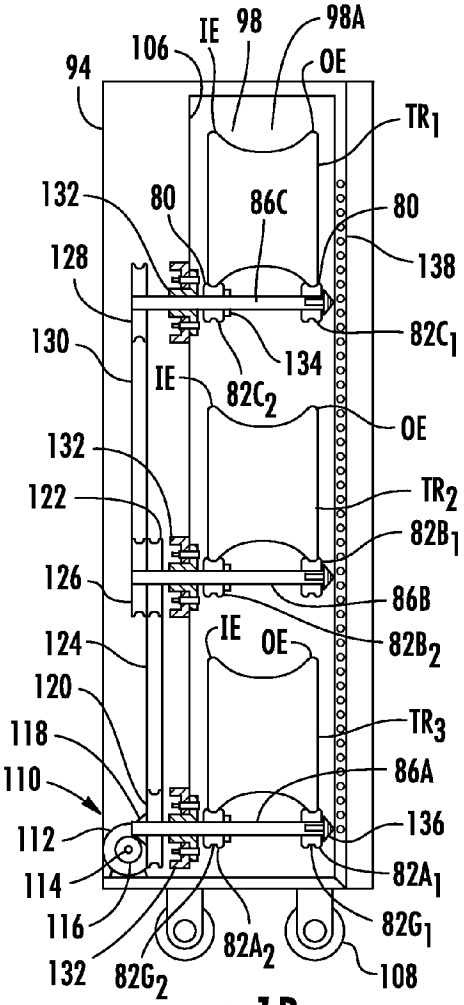
FIG. 1B illustrates a left side plan view of a portion of an interior of the embodiment of the display case shown in FIG. 1A for displaying a plurality of tire rims.

Reference will now be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

Although the terms first, second, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of a system or apparatus and are not intended to limit the scope of the subject matter disclosed herein.

The present subject matter discloses display cases and related methods for displaying one or more automobile tire rims. The display case can comprise a frame and at least one set of rollers disposed on the frame. The set of rollers can comprise at least one driver roller that is rotatable by a driver, such as a drive train having a motor in combination with belts and pulleys, for example. The rollers of the set of rollers can be positioned relative to each other to support a tire rim on the rollers so that the tire rim is rotatable upon the rotation of the at least one driver roller. In some embodiments, the set of rollers can be two rollers with a driver roller that can be rotated directly or indirectly by the driver and a driven roller that is freely rotatable so that, as the driver roller is driven by the driver to rotate the tire rim, the rotation of the tire rim can then rotate the freely rotating driven roller in the same direction as the driver roller.

The frame can provide a structure for facilitating the securing of the set of rollers in proper position relative to one another to provide support to the tire rim and to rotate the tire rim. In some embodiments, the frame can comprise a housing that can encase the tire rim and the set of rollers on which the tire rim resides. Such a housing can comprise a front wall, a back wall and two opposing side walls and an interior within the walls. The front wall can have a viewing window therein that allows the tire rim to be viewed by potential customers that may pass the display case. In some embodiments, the side walls can also possess viewing windows that permit the viewing for the tire rims disposed therein from one or both sides. The viewing windows can be made of a transparent and/or translucent material. For example, the viewing windows can comprise transparent glass or plastic material. For instance, in some embodiments, the viewing windows can be tempered glass.

The driver can be housed within the interior of the housing. In such embodiments, a divider wall can reside between the front and back walls and can extend from side wall to side wall. The divider wall can create a driver enclosure area for the driver, such as a drive train, that hides the driver from view. The housing can further comprise a door that forms at least a portion of the front wall of the housing. The door can provide access to the interior of the housing. In such embodiments, the door can comprise at least a portion of the viewing window of the front wall. Further, the door can further comprise a lock for securing the door in a closed position to prevent unauthorized access to any tire rims that reside in the interior of the housing.

In some embodiments of the display case, a lighting system can be disposed within the interior of the housing for enhancing the display of the tire rim. For example, the lighting system can comprise strips of light emitting diodes (LEDs) disposed in corners of the housing formed by the intersections of the side walls with the front wall. The light from the LEDs can emit light toward a tire rim on display to highlight the tire rim by increasing the light reflected off of the tire rim. Depending on the embodiment of the display case, the LEDs can produce white light and/or colored light such as red, green, or blue, for example.

To facilitate maintaining the tire rim on the rollers as it is rotated, each roller of the set of rollers can comprise one or more grooves for receiving a portion of the tire rim. For example, in embodiments with a pair of rollers, such as a driver roller and driven roller described above, each roller can comprise two grooves for receiving a portion of the tire rim. Such pair of rollers can be used for displaying different tire rims having the same width. In some embodiments, where four rollers are used, each roller can have a single groove for holding a single edge of the tire rim.

In some embodiments, the display case can comprise a driving axle attached to the frame with the driver being in driving communication with the driving axle and a driven shaft disposed within the frame. In such embodiments, the driven shaft can be operatively aligned with the driving axle. The driving axle and driven shaft can be mounted to the frame, such as a housing, by a bearing sleeve that permits the driving axle and the driven shaft to freely rotate. The driving axle can be engaged by the driver in various ways to cause the driving axle to rotate at a given speed. For example, the driver can comprise a motor in combination with gears, bevel gears, chains, belts, pulleys, and gear pulleys that can be used to rotate the driving axle. A controller, such as a variable speed controller, can be used to control the speed of the motor to control the speed of the rotation of the tire rims, rollers, and/or driving axle. In some embodiments, the driven shaft can freely rotate.

The set of rollers that are used to support and rotate the tire rim can be placed or secured on the driving axle and the driven shaft. In some embodiments, the set of rollers in the display case can comprise a driver roller and a driven roller with the driver roller being secured on the driving axle and the driven roller being placed or secured on the driven shaft.

In some embodiments, the set of rollers can comprises a first driver roller, a second driver roller, a first driven roller, and a second driven roller. In such embodiments, the first and second driver rollers can be placed or secured on the driving axle and the first and second driven rollers can be placed or secured on the driven shaft with the first driver roller alignable with the first driven roller and the second driver roller alignable with the second driven roller. In such embodiments, the first and second driver rollers can be space apart from each other at a first distance along the driving axle, while the first and second driven rollers are space apart from each other at a second distance along the driven shaft. The first distance between the first and second drive rollers and the second distance between the first and second driven rollers can be the same depending on how the tire rim rests on the various rollers.

For example, the first driver roller and the first driven roller can each form a groove therein so that an inner edge of the tire rim can be positioned in these grooves. Similar, the second driver roller and the second driven roller can each form a groove therein so that an outer edge of the tire rim can be positioned in these grooves. The grooves in the various rollers can help to hold the tire rim in place and to facilitate friction between the various rollers and the tire rim to facilitate rotation. In some embodiments, the first and/or second driver rollers can be adjustably secured along the driving axle and at least one of the first or second driven rollers can be adjustably positionable along the driven shaft so that the first distances between the first and second driver rollers and the second distance between the first and second driven rollers are adjustable to permit tire rims of different widths to be accommodated thereon.

In some embodiments, the driving axle and the driven shaft can be fixedly attached to the frame, or housing, of the display case. In some embodiments, the driving axle and the driven shaft are disposed within a horizontal plane and the driven shaft can be configured to be securably adjustable along the horizontal plane in a first direction and a second direction. In this manner, the distance between the driver roller and the driven roller can be increased or decreased to support tire rims of different circumferences on the rollers on the frame so that the tire rim is rotatable upon the rotation of the driver roller.

To rotate the driving axles and/or the driver rollers, a driver can be used as described above. The driver can include any mechanism or drive train used to transfer power to rotate the driving axles and/or the driver rollers. For example, the driver can comprise a motor having a motor drive shaft in operative communication with the driving axle. The motor can be controlled by a controller that can be secured to the display case or can be remote from the display case. For example, the controller can be secured to the frame or housing of the display case. In some embodiments, the driver can further comprise one more beveled gears that can be secured to the motor and a driving axle or driver roller. In some embodiments, the driver further can comprise a pulley, such as a gearpulley, disposed on the driving axle and a belt that engages the pulley and is operative rotatable by the motor drive shaft.

In some embodiments of the display case in which multiple tire rims can be displayed, a plurality of driving axles can be rotatably secured to the frame with the driver being in driving communication with the driving axles and a plurality of driven shafts can be rotatably secured to the frame with each driven shaft operative aligned with a corresponding driving axle of the plurality of driving axles. In such embodiments, a plurality of sets of rollers can be used that can correspond to the number of tire rims to be displayed. Each set of rollers can comprise one or more driver rollers secured on a corresponding driving axle of the plurality of driving axles. Each set of rollers can also comprise one or more driven rollers secured on a corresponding driven shaft of the plurality of driven shafts. In such embodiments, the one or more driver rollers and the one or more driven rollers of each set of rollers can be positioned at distances relative to each other to support a tire rim on the set of rollers within the housing so that a plurality of tire rims are supportable by the plurality of sets of rollers and are rotatable upon the rotation of the respective driver rollers. In some embodiments, the driver and the plurality of driving axles can be configured to rotate at least one of the tire rims in a direction opposite to a direction of rotation of the other tire rims.

In some embodiments, the display case for displaying automobile tire rims can comprise a housing that has a front wall with a viewing window disposed within the front wall, a back wall and two opposing side walls and an interior within the walls. A plurality of driving axles and a plurality of driven shafts can be disposed within the interior of the housing. Each driven shaft can be operative aligned with a corresponding driving axle of the plurality of driving axles. A driver can be configured to drivingly engage the driving axles to rotate the driving axles. In some embodiments, the driver can reside within the interior of the housing. The display case can also comprise a plurality of sets of rollers. Each set of rollers can comprise first and second driver rollers secured on a corresponding driving axle of the plurality of driving axles and first and second driven rollers secured on a corresponding driven shaft of the plurality of driven shafts. The driver rollers and driven rollers of each set of rollers can be positioned at distances relative to each other to support a tire rim on the set of rollers within the housing so that a plurality of tire rims are viewable through the viewing window and rotatable upon the rotation of the respective driver rollers.

In some embodiments, the plurality of driving axles and the plurality of driven shafts can comprise first, second, and third driving axles and first, second, and third corresponding driven shafts. In such embodiments, the driver can comprises a motor having a motor drive shaft on which a bevel gear is disposed that operatively engages a bevel gear disposed on the first driving axle. The driver can also comprise gear pulleys disposed on the first driving axle, the second driving axle, and the third driving axle, and at least one belt that operatively engages the gear pulleys. In such embodiments, as the motor rotates the first driving axle through the interactions of the bevel gears, the belt and gear pulleys can rotate the second and third driving axles. More particularly, in some embodiments, a first gear pulley and a second gear pulley can be disposed on the second driving axle that is disposed within the interior of the housing between the first and third driving axles. The first gear pulley on the second driving axle can be operatively aligned with a gear pulley disposed on the first driving axle. Similarly, the second gear pulley on the second driving axle can be operatively aligned with a gear pulley disposed on the third driving axle. A first belt can operatively engage the first gear pulley on the second driving axle and the gear pulley on the first driving axle. Similarly, a second belt can operatively engage the second gear pulley on the second driving axle and the gear pulley on the third driving axle.

Thus, through these embodiments of display cases, a tire rim can be placed on each set of rollers such that the set of rollers support the tire rim. Each tire rim can then be rotated with at least one driver roller of the corresponding set of rollers. In some embodiments as described, driving axles on which the driver rollers reside can be rotated with the driver so that the driver rollers rotate the tire rim residing thereon. In some embodiments, at least one tire rim can be rotated in a direction different from a direction of rotation of the other tire rims.

Figure 1A:
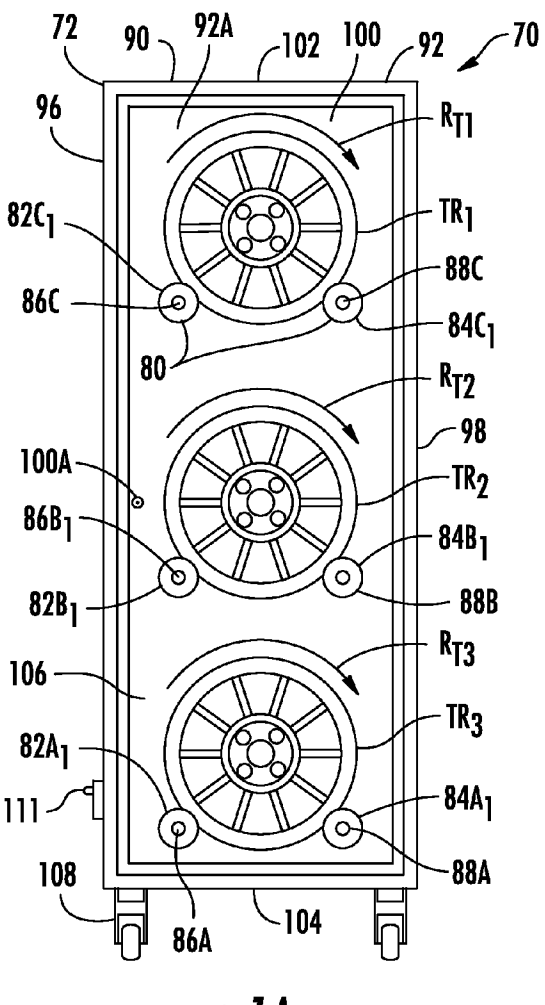
FIG. 1A illustrates a front side plan view of an embodiment of a display case for displaying a plurality of tire rims in a vertical direction according to the subject matter disclosed herein.

FIGS. 1A and 1B illustrate an embodiment of a display case, generally designated 70, for displaying a plurality of automobile tire rims $TR_1$, $TR_2$, $TR_3$. Display case 70 can comprise a frame 72. In some embodiments, frame 72 can comprise a frame made from metal angle iron around the periphery. Such a frame can have one or more walls comprising sheet metal, plastic and/or glass, for example.

In the embodiment of display case 70, frame 72 can comprise a housing 90 that has a front wall 92 with a viewing window 92A disposed therein, a back wall 94 and two opposing side walls 96, 98. Housing 90 can have a top wall 102 and a bottom wall 104 as well. Walls 92, 94, 96, 98, 102, 104 can define an interior of housing 90. Housing 90 can comprise a door 100 that forms at least a portion of front wall 92 of housing 90. Door 100 can provide access to the interior of housing 90. Door 100 can comprise at least a portion of viewing window 92A of front wall 92 through which tire rims $TR_1$, $TR_2$, $TR_3$ can be viewed by potential customers passing by display case 70. Further, door 100 comprises a lock 100A for securing door 100 in a closed position to prevent unauthorized access to tire rim $TR_1$, $TR_2$, $TR_3$ that reside in the interior of housing 90. Further, side wall 96 can include a viewing window (not shown) and side wall 98 can include a viewing window 98A that permit the viewing for tire rims $TR_1$, $TR_2$, $TR_3$ from either side 96, 98. Viewing windows 92A, 98A can be made of a transparent and/or translucent material. For example, viewing windows 92A, 98A can comprise transparent glass or plastic material. For instance, in some embodiments, the viewing windows 92A, 98A can be tempered glass.

Display case 70 can also comprise a plurality of driving axles, for example, first driving axle 86A, second driving axle 86B, and third driving axle 86C, can be disposed within the interior of housing 90. Similarly, a plurality of driven shafts, for example, first driven shaft 88A, second driven shaft 88B, and third driven shaft 88C, can also be disposed within the interior of housing 90, with each driven shaft 88A, 88B, 88C being operative aligned with a corresponding driving axle 86A, 86B, 86C. As shown in FIG. 1A, first, second, and third driving axles 86A, 86B, 86C can be aligned in a vertical direction on a same side of display case 70. Similarly, first, second, and third driven shafts 88A, 88B, 88C can be aligned in a vertical direction on an opposite side of display case 70.

In particular, driving axles 86A, 86B, 86C and driven shafts 88A, 88B, 88C can be mounted in a divider wall 106, which can be considered part of frame 72 or housing 90. For example, driving axles 86A, 86B, 86C and driven shafts 88A, 88B, 88C can be mounted in divider wall 106 with bearing sleeves 132. Each bearing sleeve 132 can be mounted to divider wall 106 and can include two (2) bearings at each end of the respective bearing sleeve 132 to provide free and smooth rotation and support for the respective driving axles 86A, 86B, 86C and/or driven shafts 88A, 88B, 88C. Divider wall 106 can reside between front wall 92 and back wall 94 and can extend from side wall 96 to side wall 98. Divider wall 106 can divide the interior of housing 90 into a display area where tire rims $TR_1$, $TR_2$, $TR_3$ are displayed and a driver enclosure area where a driver, or drive train, 110 is hidden from view. Driver 110, which can reside or primarily reside in the driver enclosure area, can be configured to drivingly engage the driving axles 86A, 86B, 86C to rotate driving axles 86A, 86B, 86C as described in more detail below.

Additionally, display case 70 can comprise a plurality of sets 80 of rollers. Each set 80 of rollers can comprise first and second driver rollers secured on a corresponding driving axle. For example, a first driver roller 82$A_1$ and a second driver roller 82$A_2$ can be placed or secured on first driving axle 86A. Similarly, a first driver roller 82$B_1$ and a second driver roller 82$B_2$ can be placed or secured on second driving axle 86B and a first driver roller 82$C_1$ and a second driver roller 82$C_2$ can be placed or secured on third driving axle 86C. Each set 80 of rollers can also comprise first driven rollers 84$A_1$, 84$B_1$, 84$C_1$, and corresponding second driven rollers (not shown) secured on a corresponding first, second, and third driven shafts 88A, 88B, 88C. The driver rollers and driven rollers of each set 80 of rollers can be positioned at distances relative to each other to support a respective tire rim $TR_1$, $TR_2$, $TR_3$ on the set 80 of rollers within housing 90 so that the tire rims $TR_1$, $TR_2$, $TR_3$ are viewable through viewing window 92A and rotatable upon the rotation of the respective driver rollers 82$A_1$, 82$A_2$, 82$B_1$, 82$B_2$, 82$C_1$, 82$C_2$.

First 82$A_1$, 82$B_1$, 82$C_1$ and second 82$A_2$, 82$B_2$, 82$C_2$ driver rollers and first 84$A_1$, 84$B_1$, 84$C_1$ and second (not shown) driven rollers can be secured to their respective driving axles 86A, 86B, 86C and driven shafts 88A, 88B, 88C in various ways. For example, all the driver rollers and the driven rollers can be fixedly secured to their respective driving axles and driven shafts with a key and/or set screw tightened against the corresponding driving axle or driven shaft so that the driver rollers turn with the driving axle and the driven rollers turn with the driven shaft. In some embodiments, first 82$A_1$, 82$B_1$, 82$C_1$ and second 82$A_2$, 82$B_2$, 82$C_2$ driver rollers can be fixedly secured to their respective driving axles 86A, 86B, 86C and first 84$A_1$, 84$B_1$, 84$C_1$ and second (not shown) driven rollers can freely rotate about their respective driven shafts 88A, 88B, 88C. In some such embodiments, driven shafts 88A, 88B, 88C can be fixedly attached to housing 90, for example, by mounting sleeves or brackets, and the first and second driven rollers can rotate about the driven shafts, for example, by a bearing placed within the respective driven rollers.

In some embodiments, second driver rollers 82$A_2$, 82$B_2$, 82$C_2$ and second driven rollers (not shown) proximal to divider wall 106 can be fixedly secured to their respective driving axles 86A, 86B, 86C and driven shafts 88A, 88B, 88C, while first driver roller 82$A_1$, 82$B_1$, 82$C_1$ and first driven rollers 84$A_1$, 84$B_1$, 84$C_1$ can freely rotate about their respective driving axles 86A, 86B, 86C and driven shafts 88A, 88B, 88C. In some such embodiments, second driver rollers 82$A_2$, 82$B_2$, 82$C_2$ and second driven rollers (not shown) can be secured in different manners. For example, locking collars 134 can be positioned on driving axles 86A, 86B, 86C and driven shafts 88A, 88B, 88C against the respective second driver rollers 82$A_2$, 82$B_2$, 82$C_2$ and second driven rollers (not shown) and locked in place with a set screw tightened against the respective driving axles 86A, 86B, 86C and driven shafts 88A, 88B, 88C. In some such embodiments, first driver roller 82$A_1$, 82$B_1$, 82$C_1$ and first driven rollers 84$A_1$, 84$B_1$, 84$C_1$ can be freely rotatable and freely movable along the respective driving axles 86A, 86B, 86C and driven shafts 88A, 88B, 88C toward or away from the respective second driver rollers 82$A_2$, 82$B_2$, 82$C_2$ and second driven rollers (not shown). In this manner, first driver roller 82$A_1$, 82$B_1$, 82$C_1$ and first driven rollers 84$A_1$, 84$B_1$, 84$C_1$ can be easily adjusted to fit tire rims of varying widths. First driver roller 82$A_1$, 82$B_1$, 82$C_1$ and first driven rollers 84$A_1$, 84$B_1$, 84$C_1$ can rotate from friction force from the weight of tire rims $TR_1$, $TR_2$, $TR_3$ at generally the same speed as second driver rollers 82$A_2$, 82$B_2$, 82$C_2$ secured to the respective driving axles 86A, 86B, 86C. First driver roller 82$A_1$, 82$B_1$, 82$C_1$ and first driven rollers 84$A_1$, 84$B_1$, 84$C_1$ can thus be held in place by tire rims $TR_1$, $TR_2$, $TR_3$ after engagement. As a safety precaution, an end cap, such as a keeper washer 136, can be bolted to the end of the respective driving axles 86A, 86B, 86C and driven shafts 88A, 88B, 88C distal from divider wall 106 to prevent first driver roller 82$A_1$, 82$B_1$, 82$C_1$ and first driven rollers 84$A_1$, 84$B_1$, 84$C_1$ from falling off of the ends distal from divider wall 106 of the respective driving axles 86A, 86B, 86C and driven shafts 88A, 88B, 88C.

To rotate tire rims $TR_1$, $TR_2$, $TR_3$ in respective rotational directions $R_{T1}$, $R_{T2}$, $R_{T3}$, driving axles 86A, 86B, 86C can be rotated by driver 110. As shown in FIG. 1B, driver, or drive train, 110 can comprises a motor 112 having a motor drive shaft 114 on which a bevel gear 116 is disposed. Depending on the usage and the power required, the size of the motor can vary. In some embodiments, motor 112 can operate at 110 volts, 50 Hertz. First driving axle 86A extends through and past its bearing sleeve 132 and has a bevel gear 118 on its end. Bevel gear 116 can operatively engage bevel gear 118 disposed on first driving axle 86A.

Driver 110 can also comprise a gear pulley 120 disposed on a portion of first driving axle 86A between bevel gear 118 and mounting sleeve 132 and a gear pulley 128 disposed on a portion of third driving axle 86C that extends past its bearing sleeve 132 in the driver enclosure area of the interior of housing 90. Further, since second driving axle 86B is positioned between the first and third driving axles, driver 110 can comprise a first gear pulley 122 and a second gear pulley 126 disposed on a portion of second driving axle 86B that extends past its bearing sleeve 132 in the driver enclosure area of the interior of housing 90. Gear pulleys 120, 122, 126, 128 can be mounted to first, second, and third driving axles 86A, 86B, 86C in any suitable manner. For example, gear pulleys 120, 122, 126, 128 can be mounted to first, second, and third driving axles 86A, 86B, 86C with keys and/or set screws to hold gear pulleys 120, 122, 126, 128 securely in place to permit both the respective gear pulleys 120, 122, 126, 128 and driving axles 86A, 86B, 86C to be rotated via motor 112.

First gear pulley 122 on second driving axle 86B can be operatively aligned with gear pulley 120 disposed on first driving axle 86A. Similarly, second gear pulley 126 on second driving axle 86B can be operatively aligned with gear pulley 128 disposed on third driving axle 86C. Additionally, driver 110 can comprise first and second belts 124, 130 that can engage gear pulleys 120, 122, 126, 128 to facilitate the rotation of first second, and third driving axles 86A, 86B, 86C. In particular, first belt 124 can operatively engage first gear pulley 122 on second driving axle 86B and gear pulley 120 on first driving axle 86A. Similarly, second belt 130 can operatively engage second gear pulley 126 on second driving axle 86B and gear pulley 128 on third driving axle 86C. As motor 112 rotates first driving axle 86A through the interactions of bevel gears 116, 118, gear pulley 120 rotates belt 124 which in turn rotates gear pulley 122 and second driving axle 86B. As second driving axle 86B rotates, gear pulley 126 rotates belt 130 which in turn rotates gear pulley 128 and third driving axle 86C. By rotating first, second, and third driving axles 86A, 86B, 86C, in this manner, tire rims $TR_1$, $TR_2$, $TR_3$ rotate in respective rotational directions $R_{T1}$, $R_{T2}$, $R_{T3}$ such that rotational directions $R_{T1}$, $R_{T2}$, $R_{T3}$ are in the same direction. The gear pulleys and belts can be toothed to better control rotation. For example, in some embodiments, 27-toothed gear pulleys are used. However, the number of teeth on the gear pulleys can vary depending on the application. While gear pulleys and belts can have teeth, other pulleys and belts can be used, such as v-shaped belts and pulleys with v-shaped recesses can be used.

To facilitate maintaining tire rims $TR_1$, $TR_2$, $TR_3$ on their respective sets 80 of rollers as tire rims $TR_1$, $TR_2$, $TR_3$ rotate, each roller, for example, can have a groove, or recess, such as groove 82$G_1$ in first driver roller 82$A_1$ and groove 82$G_2$ in second driver roller 82$A_2$ on first driving axle 86A (see FIG. 1B). First driver rollers 82$A_1$, 82$B_1$, 82$C_1$ and first driven rollers 84$A_1$, 84$B_1$, 84$C_1$ can receive outer edges OE of tire rims $TR_1$, $TR_2$, $TR_3$ in their respective grooves. Second driver rollers 82$A_2$, 82$B_2$, 82$C_2$ and second driven rollers (not shown) can receive inner edge IE of tire rims $TR_1$, $TR_2$, $TR_3$ in their respective grooves. Such grooves in the driver rollers and the driven rollers can help hold tire rims $TR_1$, $TR_2$, $TR_3$ in place on the respective sets 80 of rollers. These grooves in the driver rollers and the driven rollers can also increase surface contact and friction between the rollers and respective tire rims $TR_1$, $TR_2$, $TR_3$ to facilitate rotation thereof. Other methods of creating friction drive force can be used. For example, the rollers of set 80 of rollers can comprise, can be covered, or can be coated with a gripping or friction increasing substance, or material. For example, the material can be a foam of appropriate hardness. Such material can be configured to have, or selected based on, the ability to not harm or damage the tire rims. A controller 111, such as a variable speed controller, can be used to control the speed of motor 112 and, thus, the speed of the rotation of the respective driving axles 86A, 86B, 86C, driver rollers 82$A_1$, 82$A_2$, 82$B_1$, 82$B_2$, 82$C_1$, 82$C_2$ and tire rims $TR_1$, $TR_2$, $TR_3$. For example, the speed of drive motor 112 and rotation of tire rims $TR_1$, $TR_2$, $TR_3$ on display can be varied, for example, between 0-15 rpm by use of variable speed controller positioned next to an on/off switch on controller 111.

As shown in FIG. 1B, display case 70 can also comprise a lighting system that can be disposed within the display area of the interior of housing 90 for enhancing the display of tire rims $TR_1$, $TR_2$, $TR_3$. For example, the lighting system can comprise strips of light emitting diodes (LEDs) 138 disposed in corners of housing 90 formed by the intersections of side walls 96, 98 with front wall 92. The light from strips of LEDs 138 can emit light toward tire rims $TR_1$, $TR_2$, $TR_3$ to increase the light reflected off of tire rims $TR_1$, $TR_2$, $TR_3$. For example, four strips of LEDs 138 can be used with each converging side of the two corners having a strip of LEDs 138 thereon. This increased light reflection can draw the attention of a viewer to tire rims $TR_1$, $TR_2$, $TR_3$ as the viewer passes by display case 70. LED light strips 138 can be wired to a transformer (not shown), which in turn is wired or connected a power supply (not shown).

Display case 70 can have a standard power cord (not shown) to provide an electrical connection with an electrical outlet as a power source. Alternatively, an appropriately sized battery can serve as a power supply.

Further, display case 70 can be mounted on casters 108, such as swivel locking type casters, that provide for ease of movement of display case 70. For example, four casters 108 can be mounted to bottom wall 104. Casters 108 of display case 70 permits easy movement of display case 70 to a location where viewing by potential customers can be optimize, while allowing casters 108 and display case 70 to be locked in place to restrict movement thereof once display case 70 is in the desired location.

Figure 2A:
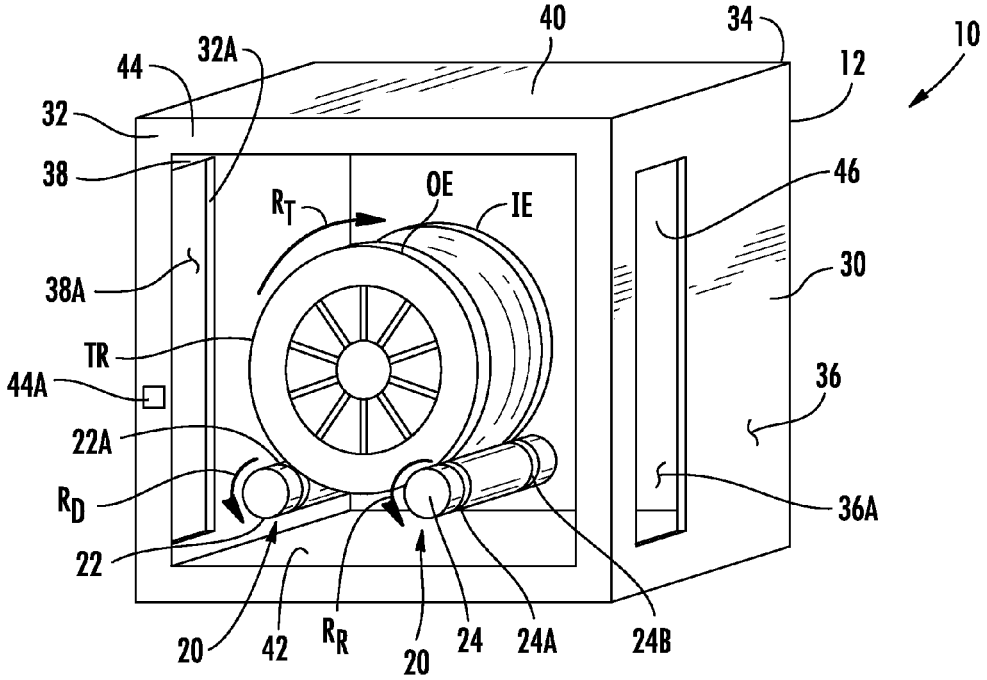
FIG. 2A illustrates a perspective view of another embodiment of a display case for displaying a tire rim according to the subject matter disclosed herein.
Figure 2C:
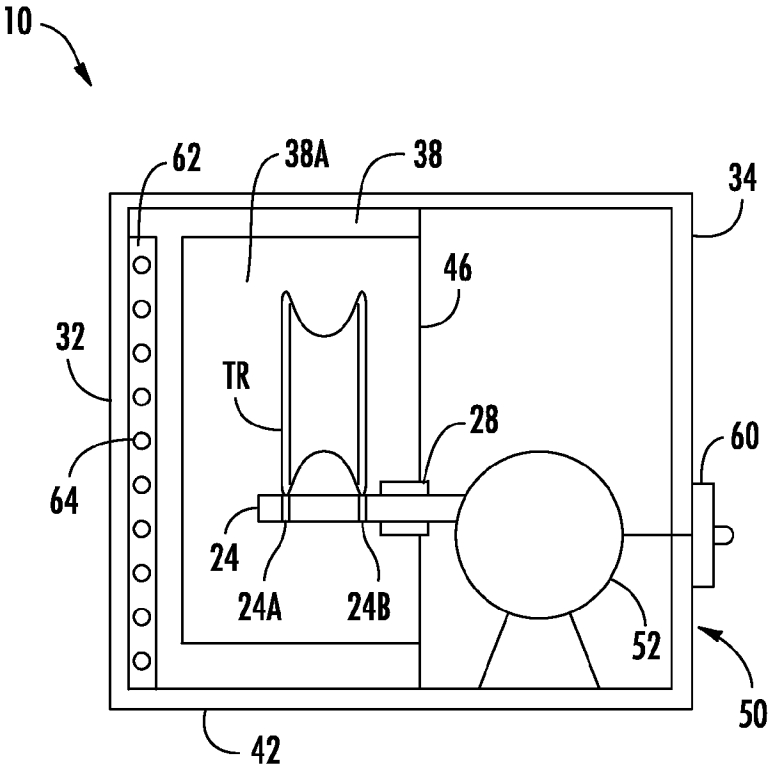
FIGS. 2B and 2C illustrate side plan views of a portion of an interior of the embodiment of the display case shown in FIG. 2A for displaying a tire rim.
Figure 2B:
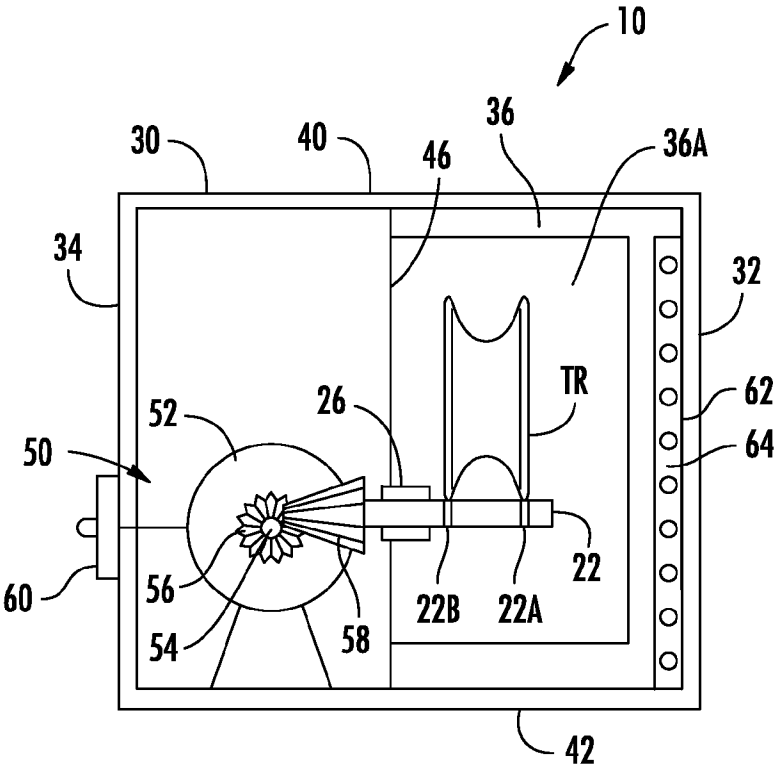

FIGS. 2A-2C illustrate another embodiment of a display case, generally designated 10, for displaying an automobile tire rim TR. Display case 10 is designed to display a single tire rim TR. In some embodiments, however, multiple display cases 10 can be stackable and alignable so that multiple tire rims TR can be displayed together. Display case 10 can comprise a frame 12 and at least one set of rollers, generally designated 20, secured to frame 12 in a manner that holds the set 20 of rollers in a fixed position relative to one another and permits the set 20 of rollers to rotate when in use. The set 20 of rollers can comprise at least one driver roller 22 that is rotatable by a driver, generally designated 50, and a driven roller 24 that is freely rotatable. Driver roller 22 can be rotated by driver 50 as explained in more detail below. As driver roller 22 is rotated in a direction $R_D$, the friction between driver roller 22 and tire rim TR causes tire rim TR to rotate in a direction $R_T$. As driver roller 22 is driven by driver 50 to rotate tire rim TR, the rotation of tire rim TR can then rotate freely rotating driven roller 24 in a direction $R_R$ through the friction created between tire rim TR and driven roller 22. As shown, rotational direction $R_R$ of driven roller 24 is in the same direction as rotational direction $R_D$ of driver roller 22. As shown, rollers 22 and 24 can be positioned relative to each other to support tire rim TR thereon so that tire rim TR is rotatable upon the rotation of driver roller 22.

To facilitate maintaining tire rim TR on rollers 22, 24 as it is rotated, roller 22 can have two grooves, or recesses, 22A, 22B (see FIG. 2B) and roller 24 can have two grooves, or recesses, 24A, 24B. Groove 22A in driver roller 22 and groove 24A of driven roller 24 can receive outer edge OE of tire rim TR. Groove 22B in roller 22 and groove 24B of roller 24 can receive inner edge IE of tire rim TR. The grooves 22A, 22B in driver roller 22 and grooves 24A, 24B in driven roller 24 can help hold tire rim TR in place on rollers 22, 24. The grooves 22A, 22B in driver roller 22 and grooves 24A, 24B in driven roller 24 can also increase surface contact and friction between rollers 22, 24 and tire rim TR to facilitate rotation.

Frame 12 can provide a structure for facilitating the securing of set 20 of rollers 22, 24 in proper position relative to one another to provide support to tire rim and to rotate the tire rim. As shown in FIGS. 2A-2C, frame 12 can comprise a housing 30 that can encase tire rim TR and set 20 of rollers 22, 24 on which tire rim TR resides. Housing 30 can comprise a front wall 32, a back wall 34 and two opposing side walls 36, 38. Housing can have a top wall 40 and a bottom wall 42 as well.

Walls 32, 34, 36, 38, 40, 42 can define an interior of housing 30. Housing 30 can comprise a door 44 that forms at least a portion of front wall 32 of housing 30. Door 44 can provide access to the interior of housing 30. Door 44 can comprise a viewing window 32A through which tire rim TR can be viewed by potential customers passing by display case 10. Door 44 further comprises a lock 44A for securing door 44 in a closed position to prevent unauthorized access to tire rim TR that resides in the interior of housing 30. Further, side wall 36 can include a viewing window 36A and side wall 38 can include a viewing window 38A that permit the viewing for tire rim TR from both sides. As above, viewing windows 32A, 36A, 38A can be made of a transparent and/or translucent material. For example, viewing windows can comprise transparent glass or plastic material. For instance, in some embodiments, the viewing windows can be tempered glass.

As shown in FIGS. 2A-2C, driver 50 can be housed within the interior of housing 30. A divider wall 46, which can be considered part of frame 12 or housing 30, can reside between front wall 32 and back wall 34 and can extend from side wall 36 to side wall 38. Divider wall 46 can divide the interior of housing 30 into a display area where tire rim TR rest on rollers 22, 24 and a driver enclosure area where driver 50 is hidden from view. In this embodiment, rollers 22, 24 can be mounted in divider wall 46 with bearing sleeves 26, 28 respectively. As shown in FIGS. 2B and 2C, driver 50 in display case 10 can comprise a motor 52 have a shaft 54. A bevel gear 56 can reside on shaft 54. As shown in FIG. 2B, roller 22 can extend through bearing sleeve 26 and can have a bevel gear 58 secured on its end that matingly engages with bevel gear 56 on motor shaft 54. A controller 60, such as a variable speed controller, can be used to control the speed of motor 52 and, thus, the speed of the rotation of driver roller 22 and tire rim TR.

As shown in FIGS. 2B and 2C, display case 10 can also comprise a lighting system 62 that can be disposed within the display area of the interior of housing 30 for enhancing the display of tire rim TR. For example, lighting system 62 can comprise strips of light emitting diodes (LEDs) 64 disposed in corners of housing 30 formed by the intersections of side walls 36, 38 with front wall 32. The light from the strips of LEDs 64 can emit light toward tire rim TR to increase the light reflected off of tire rim TR. This increased light reflection highlights tire rim TR and draws the attention of a viewer to tire rim TR. Depending on the embodiment of the display case, the LEDs can produce white light and/or colored light such as red, green, or blue, for example.

Figure 3A:
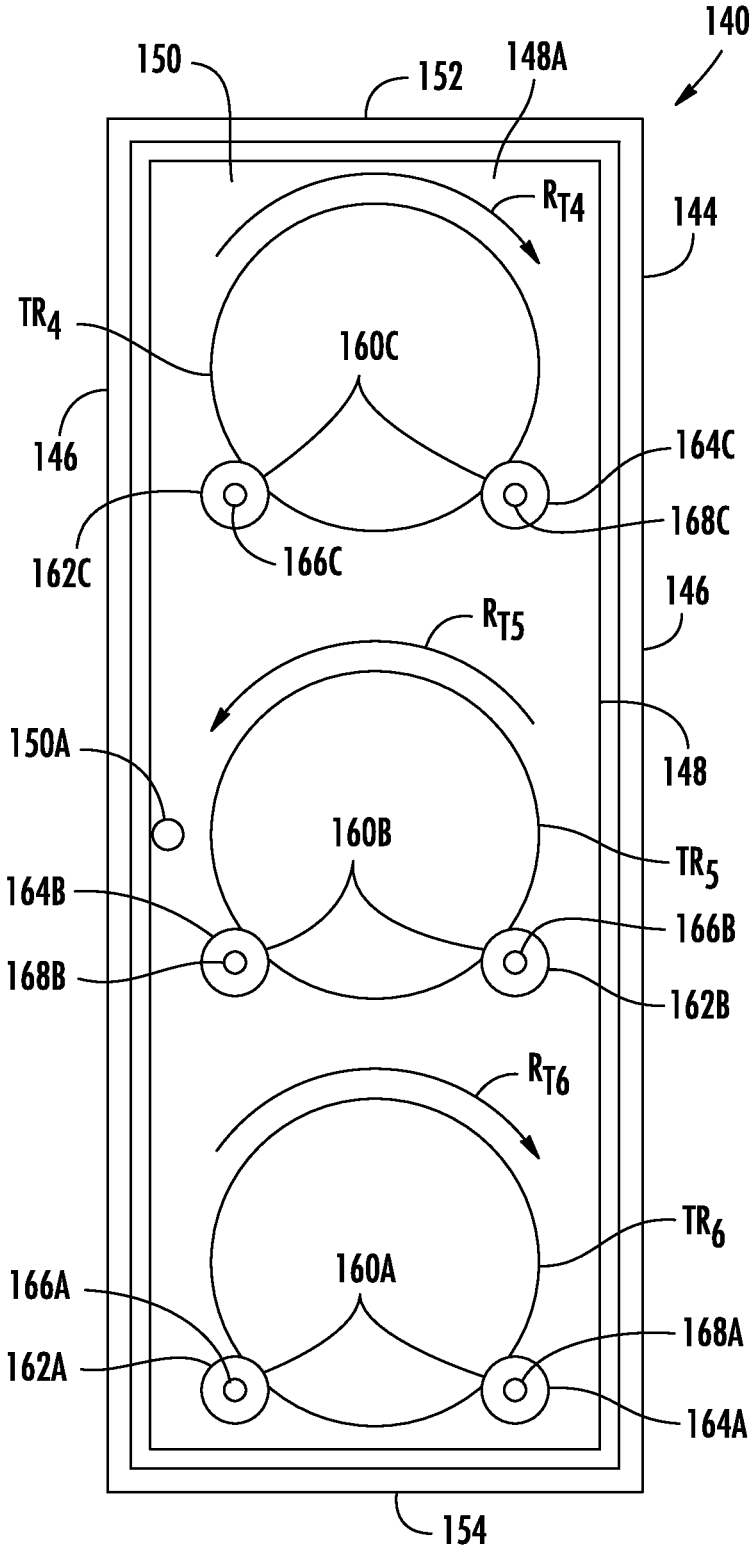
FIG. 3A illustrates a front side plan view of an additional embodiment of a display case for displaying a plurality of tire rims in a vertical direction according to subject matter disclosed herein.
Figure 3B:
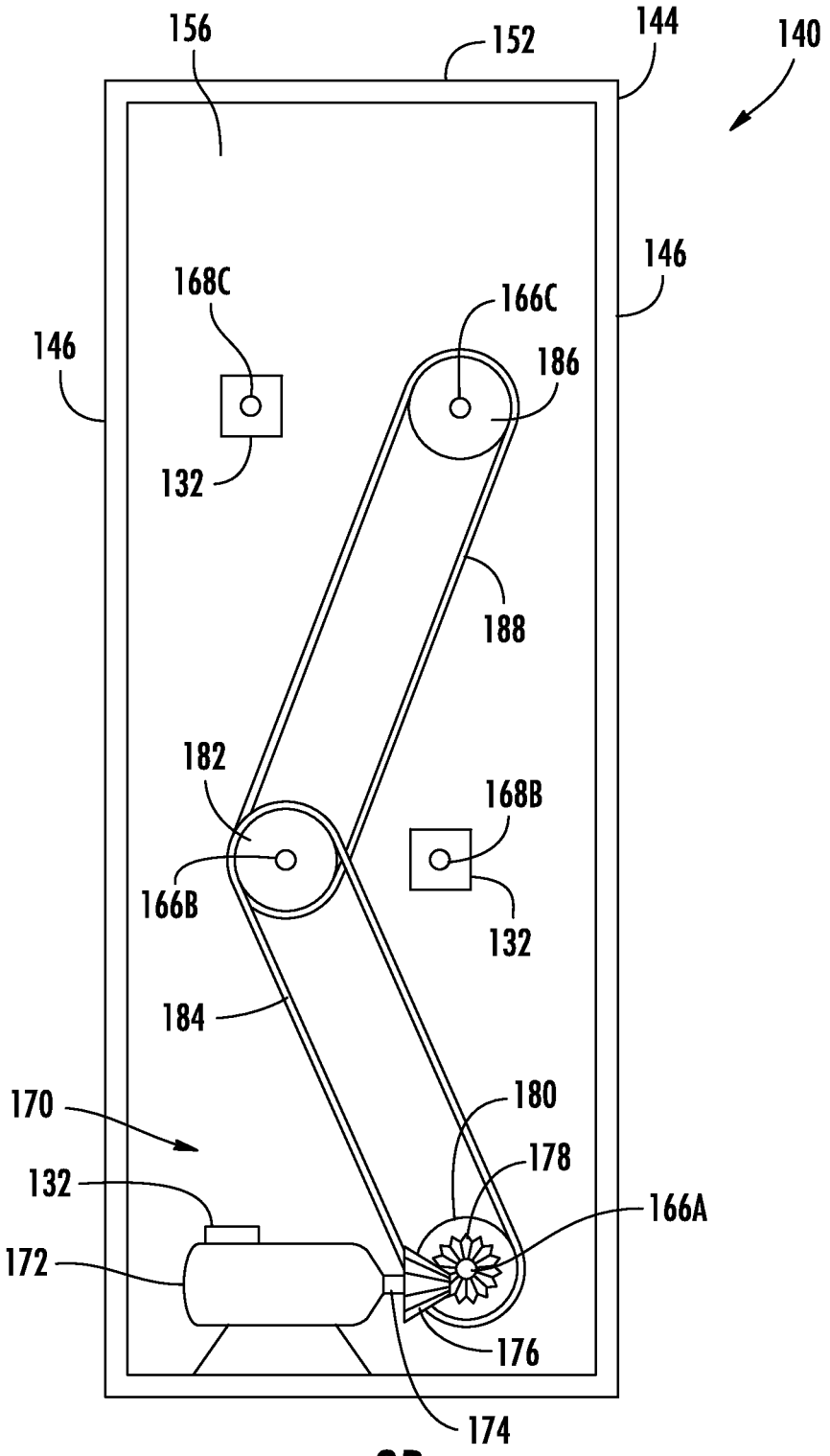
FIG. 3B illustrates a back side plan view of a portion of an interior of the embodiment of the display case shown in FIG. 3A for displaying a plurality of tire rims.

FIGS. 3A and 3B illustrate a different embodiment of a display case, generally designated 140, for displaying a plurality of automobile tire rims $TR_4$, $TR_5$, $TR_6$ in a vertical direction that is similar to display case 70 illustrated in FIGS. 1A and 1B. As seen in FIG. 3B, display case 140 is configured so that tire rim $TR_5$ rotates in a different rotational direction $R_{T5}$ than a rotational direction $R_{T4}$ of tire rim $TR_4$ and a rotational direction $R_{T6}$ of tire rim $TR_6$. The different direction of rotation can be accomplished in different manners with one example being provided below. By having tire rims $TR_4$, $TR_5$, $TR_6$ rotating in different directions, the visibility of the display of tire rims $TR_4$, $TR_5$, $TR_6$ in display case 140 can likely increase.

In this embodiment, display case 140 can comprise a housing 144 that has a front wall 148 with a viewing window 148A disposed therein, a back wall (not shown) and two opposing side walls 146. Housing 144 can have a top wall 152 and a bottom wall 154 as well. Walls 148, 146, 152, 154 can define an interior of housing 144. In this embodiment, display case 140 does not have casters attached to bottom wall 154. Housing 144 can comprise a door 150 that forms at least a portion of front wall 148 of housing 144. Door 150 can provide access to the interior of housing 144. Door 150 can comprise at least a portion of viewing window 148A of front wall 148 through which tire rims $TR_4$, $TR_5$, $TR_6$ can be viewed by potential customers passing by display case 140. Further, door 150 comprises a lock 150A for securing door 150 in a closed position to prevent unauthorized access to tire rim $TR_4$, $TR_5$, $TR_6$ that reside in the interior of housing 144.

Display case 140 can also comprise a plurality of driving axles, for example, first driving axle 166A, second driving axle 166B, and third driving axle 166C, that can be disposed within the interior of housing 144. Similarly, a plurality of driven shafts, for example, first driven shaft 168A, second driven shaft 168B, and third driven shaft 168C, can also be disposed within the interior of housing 144 with each driven shaft 168A, 168B, 168C being operative aligned with a corresponding driving axle 166A, 166B, 166C. As can be seen from FIGS. 3A and 3B, first and third driving axles 166A, 166C can be aligned in a vertical direction on a same side of display case 140 with second driving axle 166B on the opposite side of display case 140. Similarly, first and third driven shafts 168A, 168C can be aligned in a vertical direction on the opposite side of display case 140 and in alignment with second driving axle 166B, while second driven shaft 168B can reside on the same side of display case 140 and in vertical alignment with first and third driving axles 166A, 166C.

Additionally, as described above, display case 140 can comprise a plurality of sets 160A, 160B, 160C of rollers. Each set 160A, 160B, 160C of rollers can comprise driver rollers 162A, 162B, 162C secured on a corresponding driving axle 166A, 166B, 166C. Each set 160A, 160B, 160C of rollers can also comprise driven rollers 164A, 164B, 164C secured on a corresponding driven shaft 168A, 168B, 168C as described above. The driver rollers and driven rollers of each set 160A, 160B, 160C of rollers can be positioned at distances relative to each other to support a respective tire rim $TR_4$, $TR_5$, $TR_6$ on the set 160 of rollers within housing 144 so that the tire rims $TR_4$, $TR_5$, $TR_6$ are viewable through viewing window 152A and rotatable upon the rotation of the respective driver rollers 162A, 162B, 162C.

Driving axles 166A, 166B, 166C and driven shafts 168A, 168B, 168C can be mounted in a divider wall 156, which can be considered part of housing 144 and can reside between front wall 148 and the back wall and can extend from side wall 146 to side wall 146. For example, driving axles 166A, 166B, 166C and driven shafts 168A, 168B, 168C can be mounted in divider wall 156 with bearing sleeves 132 (see FIG. 3B). A driver, or drive train, 170, which can reside within the interior of housing 144 between divider wall 156 and the back wall, can be configured to drivingly engage the driving axles 166A, 166B, 166C to rotate driving axles 166A, 166B, 166C as described in more detail below.

As shown in FIG. 3B, driver, or drive train, 170 can comprises a motor 172 having a motor drive shaft 174 on which a bevel gear 176 is disposed. Depending on the usage and the power required, the size of the motor can vary. First driving axle 166A extends through and past its bearing sleeve and has a bevel gear 178 on its end. Bevel gear 176 can operatively engage bevel gear 178 disposed on first driving axle 166A. Driver 170 can also comprise a gear pulley 180 disposed on a portion of first driving axle 166A between bevel gear 178 and its bearing sleeve and a gear pulley 186 disposed on a portion of third driving axle 166C that extends past its bearing sleeve in the driver enclosure area of the interior of housing 144. Further, since second driving axle 166B is positioned between the first and third driving axles, driver 170 can comprise a first gear pulley 182 and a second gear pulley (not shown, but in similar placement relative to first gear pulley 182 on driving axle 166B as first gear pulley 122 is to second gear pulley 126 on driving axle 86B shown in FIG. 1B) disposed on a portion of second driving axle 166B that extends past its bearing sleeve in the driver enclosure area of the interior of housing 144.

First gear pulley 182 on second driving axle 166B can be operatively aligned with gear pulley 180 disposed on first driving axle 166A. Similarly, the second gear pulley on second driving axle 166B can be operatively aligned with gear pulley 186 disposed on third driving axle 166C. Additionally, driver 170 can comprise a first belt 184 that can operatively engage first gear pulley 182 on second driving axle 166B and gear pulley 180 on first driving axle 166A. As shown in FIG. 3B, first belt 184 extends diagonally across a portion of display case 140 from first driving axle 166A on one side of display case 140 to second driving axle 166B on an opposite side of display case 140. Similarly, a second belt 188 can operatively engage the second gear pulley (not shown) on second driving axle 166B and gear pulley 186 on third driving axle 166C. As shown in FIG. 3B, second belt 188 extends diagonally across a portion of display case 140 from second driving axle 166B on the opposite side of display case 140 to third driving axle 166C on the same side of display case 140 as first driving axle 166A. As motor 172 rotates first driving axle 166A through the interactions of bevel gears 116, 118, gear pulley 180 rotates belt 184 which in turn rotates first gear pulley 182 and second driving axle 166B. As second driving axle 166B rotates, the second gear pulley behind first gear pulley 182 rotates belt 130 which in turn rotates gear pulley 186 and third driving axle 166C. By having second driving axle 166B and second driven shaft 168B reversed and rotating first, second, and third driving axles 166A, 166B, 166C, in this manner, tire rim $TR_5$ rotates in a different rotational direction $R_{T5}$ from tire rims $TR_4$, $TR_5$, which rotate in the same respective rotational directions $R_{T4}$, $R_{T6}$ as shown in FIG. 3B.

Figure 4:
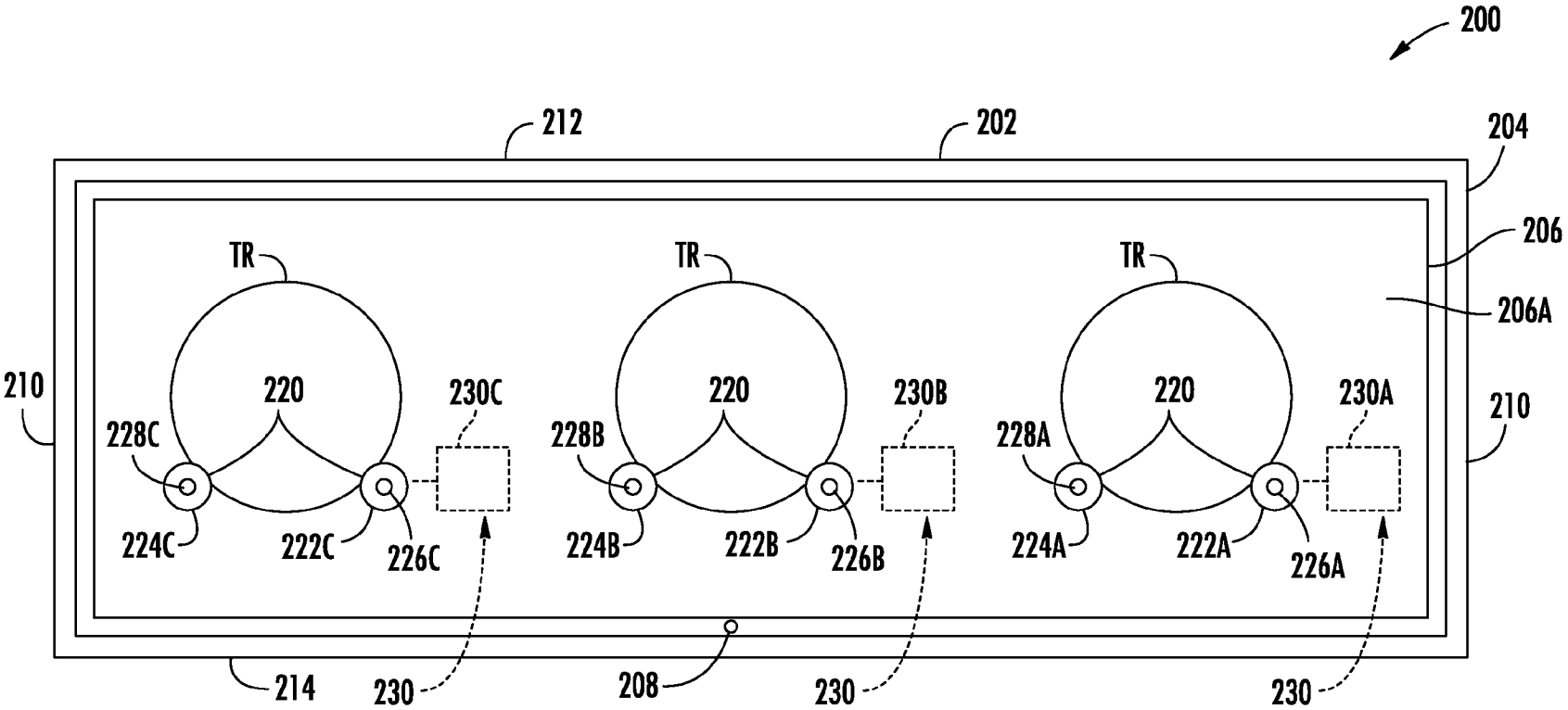
FIG. 4 illustrates a front side plan view of a further embodiment of a display case for displaying a plurality of tire rims in a horizontal direction according to the subject matter disclosed herein.

FIG. 4 illustrates another embodiment of a display case, generally designated 200, for displaying a plurality of automobile tire rims TR that is similar to display case 70 illustrated in FIGS. 1A and 1B. In this embodiment, display case 200 displays automobile tire rims TR in a horizontal direction.

Display case 200 can comprise a housing 202 that has a front wall 204 with a viewing window 206A disposed in a door 206, a back wall (not shown) and two opposing side walls 210. Housing 202 can have a top wall 212 and a bottom wall 214 as well. The walls can define an interior of housing 202. Door 206 can provide access to the interior of housing 202 and can comprise a lock 208 for securing door 206 in a closed position to prevent unauthorized access to tire rims TR that reside in the interior of housing 202. Display case 200 can also comprise a plurality of driving axles, for example, driving axles 226A, 226B, 226C and driven shafts 228A, 228B, 228C with each driven shaft 228A, 228B, 228C being operative aligned with a corresponding driving axle 226A, 226B, 226C. As shown in FIG. 4, driving axles 226A, 226B, 226C and driven shafts 228A, 228B, 228C can be aligned in a horizontal direction in display case 200.

Additionally, display case 200 can comprise a plurality of sets 220 of rollers. Each set 220 of rollers can comprise driver rollers 222A, 222B, 222C secured on a corresponding driving axle 226A, 226B, 226C as described above. Each set 220 of rollers can also comprise driven rollers 224A, 224B, 224C secured on a corresponding driven shaft 228A, 228B, 228C as described above. Driver rollers 222A, 222B, 222C and driven rollers 224A, 224B, 224C of each set 220 of rollers can be positioned at distances relative to each other to support a respective tire rim TR on set 220 of rollers within housing 202 so that tire rims TR are viewable through viewing window 206A and rotatable upon the rotation of the respective driver rollers 222A, 222B, 222C.

To rotate tire rims TR, driving axles 226A, 226B, 226C are rotated by a driver, generally designated 230, which can comprise individual motors 230A, 230B, 230C (shown schematically in dotted lines) that are in driving communication with corresponding driving axles 226A, 226B, 226C. Individual motors 230A, 230B, 230C can controllably and drivingly engage the respective driving axles 226A, 226B, 226C to which they are linked in an independent manner. In this manner, the speed and direction of rotation for each tire rim TR can be controlled.

Figure 5B:
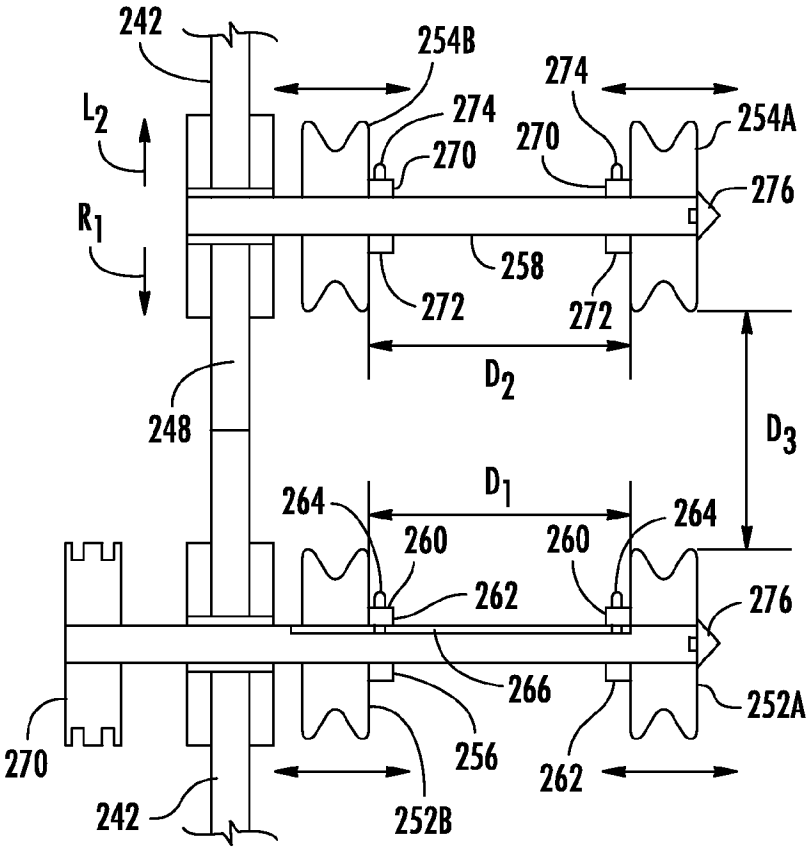
FIG. 5B illustrates a schematic horizontal cross-sectional view of the portion of the embodiment of the display case according to FIG. 5A along a horizontal plane in which a driving axle and a driven shaft in the display case reside.
Figure 5A:
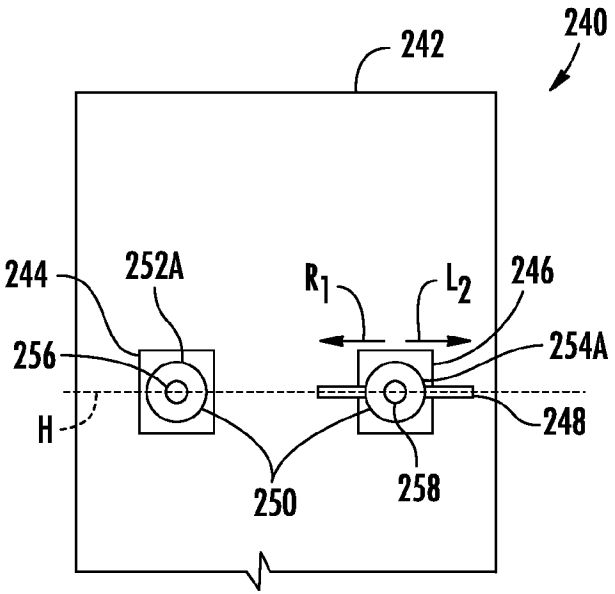
FIG. 5A illustrates a schematic front side plan view of a portion of an embodiment of a display case for displaying a tire rim according to the subject matter disclosed herein.

FIGS. 5A and 5B illustrate a portion of another embodiment of a display case, generally designated 240. In this embodiment, display case 240 can comprise a driving axle 256 attached to a frame 242 with a driver (not shown) in driving communication with driving axle 256 and a driven shaft 258 secured to frame 242. As shown, driven shaft 258 can be operatively aligned with driving axle 256 within a horizontal plane H. Driving axle 256 and driven shaft 258 can be mounted to frame 242 by bearing sleeves 244, 246 that permits driving axle 256 and driven shaft 258 to freely rotate. Display case 240 can also comprise a set 250 of rollers that comprise driver rollers 252A, 252B and driven rollers 254A, 254B. Driver rollers 252A, 252B can reside on driving axle 256 and driven rollers 254A, 254B can reside on driven shaft 258. As above, driver rollers 252A, 252B and driven rollers 254A, 254B can be used to support a tire rim to be displayed. Driving axle 256 can have one or more driver mechanisms, such as a pulley 270 secured on an end distal from driver roller 252A.

In this embodiment, driving axle 256 can be fixedly, but rotatably, attached to frame 242. As shown in FIGS. 5A and 5B, driven shaft 258, which can extend through frame 242, can be configured to be securably adjustable along a horizontal aperture 248 in horizontal plane H in a first direction $R_1$ and a second direction $L_2$. In this manner, a distance $D_3$ between each driver roller 252A, 252B and its corresponding driven roller 254A, 254B can be increased or decreased to better support tire rims of various circumferences on driver rollers 252A, 252B and driven rollers 254A, 254B so that each tire rim is rotatable upon the rotation of driver rollers 252A, 252B.

Further, as shown in FIG. 5B, driver rollers 252A, 252B can be adjustably securable along driving axle 256 and driven rollers 254A, 254B can be adjustably securable along driven shaft 258 so that the first distance $D_1$ between driver rollers 252A, 252B and second distance $D_2$ between driven rollers 254A, 254B can be adjustable to permit tire rims of different widths to be accommodated thereon. The ability to make driver rollers 252A, 252B and driven rollers 254A, 254B adjustable can be accomplished in different manners as outlined above. For example, as shown in FIG. 5B, all driver rollers 252A, 252B and driven rollers 254A, 254B can be secured to their respective driving axle 256 and driven shaft 258 with a locking mechanism 260, 270. For example, locking mechanism 260 on each driver roller 252A, 252B can comprise a locking collar 262 with a set screw 264 that can be tightened against driving axle 256 in a key way 266. As shown in FIG. 5B, locking mechanism 270 on each driver rollers 252A, 252B can comprise a locking collar 272 with a set screw 274 that can be tightened against the circumference of driven shaft 258. Keeper washers 276 can be secured to the ends of driving axle 256 and driven shaft 258 to prevent driver roller 252A and driven roller 254A from accidentally slipping off the respective driving axle 256 and driven shaft 258 if the associated locking mechanism 260, 270 is not engaging the respective driving axle 256 and driven shaft 258.

Thus, through these embodiments of display cases, a tire rim can be placed on each set of rollers such that the set of rollers support the tire rim. Each tire rim can then be rotated with at least one driver roller of the corresponding set of rollers. In some embodiments as described, driving axles on which the driver rollers reside can be rotated with the driver so that the driver rollers rotate the tire rim residing thereon. In some embodiments, at least one tire rim can be rotated in a direction different from a direction of rotation of the other tire rims. It is contemplated that the frame of the display case can comprise different shapes with or without an enclosure for the tire rims. For example, a display case can comprise a shape of a car with the rotating tire rims at the position of the tires. Such different shapes with different driver mechanism and different rollers fall within the scope of the present disclosure.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A display case for displaying one or more automobile tire rims, the display case comprising:

a frame;

a driver disposed within the frame;

at least one driving axle attached to the frame with the driver being in driving communication with the driving axle at least one driven shaft attached to the frame, the driven shaft being operatively aligned with the driving axle;

at least one set of rollers comprising a first driver roller, a second driver roller, a first driven roller, and a second driven roller, the first and second driver rollers being secured on the driving axle and the first and second driven rollers being secured on the driven shaft, wherein each of the first and second driver rollers and the first and second driven rollers comprise a groove being sized to receive an edge of a tire rim between walls of the groove; and at least one of the first or second driver rollers and at least one of the first or second driven rollers being adjustable so that the grooves of the first driver roller and first driven roller are alignable to receive an outer edge of a tire rim and the grooves of the second driver roller and second driven roller are alignable to receive an inner edge of the tire rim to support the tire rim on the rollers so that the tire rim is rotatable upon the rotation of the first and second driver rollers.

2. The display case according to claim 1, wherein the frame comprises a housing comprising a front wall with a viewing window therein, a back wall and two opposing side walls and an interior within the walls, and wherein the housing comprises a door forming at least a portion of the front wall of the housing with the door providing access to the interior of the housing with the door comprising at least a portion of the viewing window of the front wall.

3. The display case according to claim 2, further comprising a lighting system disposed within the interior of the housing for enhancing the display of the tire rim, the lighting system comprising strips of light emitting diodes (LEDs) disposed in corners of the housing formed by the intersections of the side walls with the front wall.

4. The display case according to claim 2, wherein the housing is stackable with housings of other display cases.

5. The display case according to claim 1, wherein the at least one driving axle comprises a plurality of driving axles rotatably secured to the frame with the driver being in driving communication with the driving axles, and wherein the at least one driven shaft comprises a plurality of driven shafts rotatably secured to the frame, each driven shaft operatively aligned with a corresponding driving axle of the plurality of driving axles.

6. The display case according to claim 5, wherein the at least one set of rollers comprises a plurality of sets of rollers, wherein the first and second driver rollers of each set of rollers are secured on a corresponding driving axle of the plurality of driving axles and wherein the first and second driven rollers of each set of rollers are secured on a corresponding driven shaft of the plurality of driven shafts, the first and second driver rollers and the first and second driven rollers of each set of rollers positionable at distances relative to each other to support a tire rim on the set of rollers so that a plurality of tire rims are supportable by the plurality of sets of rollers and are rotatable upon the rotation of the driver rollers.

7. A display case for displaying automobile tire rims, the display case comprising:

a housing comprising a front wall with a viewing window disposed within the front wall, a back wall, and two opposing side walls and an interior within the walls;

a plurality of driving axles disposed within the interior of the housing;

a plurality of driven shafts disposed within the interior of the housing, each driven shaft operative aligned with a corresponding driving axle of the plurality of driving axles; and a driver configured to drivingly engage the driving axles to rotate the driving axles; and a plurality of sets of rollers, each set of rollers comprising first and second driver rollers secured on a corresponding driving axle of the plurality of driving axles and first and second driven rollers secured on a corresponding driven shaft of the plurality of driven shafts, wherein each of the first and second driver rollers and the first and second driven rollers comprise a groove being sized to receive an edge of a tire rim between walls of the groove;

at least one of the first or second driver rollers and at least one of the first or second driven rollers for each set of the rollers being adjustable so that the grooves of the first driver roller and first driven roller are alignable to receive an outer edge of a tire rim and the grooves of the second driver roller and second driven roller are alignable to receive an inner edge of the tire rim to support the tire rim on the set of rollers within the housing so that a plurality of tire rims are viewable through the viewing window and rotatable upon the rotation of the respective driver rollers.

8. The display case according to claim 7, wherein the plurality of driving axles and the plurality of driven shafts comprise first, second, and third driving axles and first, second, and third corresponding driven shafts.

9. The display case according to claim 8, wherein the driver comprises a motor having a motor drive shaft on which a bevel gear is disposed that operatively engages a bevel gear disposed on the first driving axle, gear pulleys disposed on the first driving axle, the second driving axle and the third driving axle, and at least one belt that operatively engages the gear pulleys, so that as the motor rotates the first driving axle, the belt and gear pulleys rotate the second and third driving axles.

10. The display case according to claim 9, wherein the gear pulleys of the driver comprises a first gear pulley and a second gear pulley on the second driving axle that is disposed within the interior of the housing between the first and third driving axles, the first gear pulley on the second driving axle operatively aligned with the gear pulley disposed on the first driving axle and the second gear pulley on the second driving axle operatively aligned with the gear pulley disposed on the third driving axle and the at least one belt of the driver comprises a first belt operatively engaging the first gear pulley on the second driving axle and the gear pulley on the first driving axle and a second belt operatively engaging the second gear pulley on the second driving axle and the gear pulley on the third driving axle.

11. The display case according to claim 7, wherein the housing comprises a door forming at least a portion of the front wall of the housing, the door providing access to the interior of the housing for placing of tire rims on the sets of rollers and wherein the door comprises at least a portion of the viewing window of the front wall and each of the side walls of the housing comprises a viewing window.

12. The display case according to claim 7, wherein each driving axle of the plurality of driving axles and the corresponding driven shaft of the plurality of driven shafts are disposed within a horizontal plane in the housing and each driven shaft is configured to be securably adjustable along the horizontal plane in a first direction and an opposite second direction to increase or decrease the distance between the driver rollers and the driven rollers on the respective driving axle and driven shaft.

13. The display case according to claim 7, wherein at least one of the first or second driver rollers of each set of rollers are adjustably movable along the driving axle and at least one of the first or second driven rollers of each set of rollers are adjustably movable along the driven shaft so that a first distance between the first and second driver rollers and a second distance between the first and second driven rollers are adjustable to permit tire rims of different widths to be accommodated on the rollers.

14. The display case according to claim 7, wherein the driver and the plurality of driving axles are configured to rotate at least one of the tire rims in a direction opposite to a direction of rotation of the other tire rims.

* * * * *